United States Patent [19]

Klaren

[11] Patent Number: 4,522,252

[45] Date of Patent: Jun. 11, 1985

[54] METHOD OF OPERATING A LIQUID-LIQUID HEAT EXCHANGER

[75] Inventor: Dick G. Klaren, Hillegom, Netherlands

[73] Assignee: Esmil B.V., Amsterdam, Netherlands

[21] Appl. No.: 495,517

[22] Filed: May 17, 1983

[30] Foreign Application Priority Data

May 21, 1982 [NL] Netherlands ..... 8202096

[51] Int. Cl.[3] ..... F28C 3/16; F28F 9/24

[52] U.S. Cl. ..... 165/1; 165/104.16; 165/159; 165/DIG. 5; 422/146; 422/198; 422/201

[58] Field of Search ..... 165/159, 1, 160, 104.16, 165/DIG. 5; 422/198, 201, 197, 146

[56] References Cited

U.S. PATENT DOCUMENTS

| | | | |
|---|---|---|---|
| 1,528,494 | 3/1925 | Lennig | 165/DIG. 5 |
| 1,716,333 | 6/1929 | Vuilleumier | 165/159 |
| 3,732,919 | 5/1973 | Wilson | 165/110 |
| 3,921,711 | 11/1975 | Westbrock | 165/109 |
| 4,098,588 | 7/1978 | Buswell et al. | 422/197 |
| 4,300,625 | 11/1981 | Mikhailov et al. | 165/104.16 |

*Primary Examiner*—Albert W. Davis, Jr.
*Attorney, Agent, or Firm*—Stevens, Davis, Miller & Mosher

[57] ABSTRACT

In a method of operating a liquid-liquid heat exchanger the first heat exchanging medium is passed upwardly through a plurality of tubes in which a granular mass is kept fluidized by the flow of the first medium and the second heat-exchanging medium is passed downwardly through which said tubes extend spaced apart and whereby heat exchange takes place through the tube walls. To improve heat transfer between the tubes and the second medium, especially at low flow rates of the latter, said chamber contains, around and between the tubes, a loosely packed solid particulate filling material through which the second medium flows, and the longitudinal superficial velocity of the second medium between the tubes ($U_{l,s}$) satisfies the relation $0.05 < U_{l,s} < 0.25$ m/sec.

5 Claims, 1 Drawing Figure

METHOD OF OPERATING A LIQUID-LIQUID HEAT EXCHANGER

BACKGROUND OF THE INVENTION

1. Field of the Invention

The invention relates to a method of operating a liquid-liquid heat exchanger which has a plurality of upwardly directed tubes for upward movement of a first heat exchanging medium while a granular mass is kept fluidised in the tubes by the first medium and, around the tubes, a chamber for downward passage of the second heat exchanging medium.

A liquid-liquid heat exchanger of this type is disclosed in Dutch laid open patent application No. 7703939 (GB No. 1,592,232), which explains how the apparatus is dimensioned so that a condition can be created, during operation, in which the movement and/or conveyance of the granular mass in each of the tubes is almost identical.

By means of a fluidised granular mass in the tubes, more efficient heat transfer to the inner walls of the tubes is achieved, thereby reducing the costs of construction and operation of the heat exchanger, compared with a heat exchanger of the same capacity without a fluidised granular mass. This applies particularly if a liquid which has a highly contaminating action on the tube wall flows through the tubes, because the fluidised granular mass exerts a slightly abrasive action on the tube wall, thereby limiting contamination and in many cases even eliminating it.

Practical tests have shown that a heat exchanger which is provided with a fluidised granular mass in the tubes can have a heat transmission coefficient (K value) five times higher than a conventional heat exchanger which does not make use of a fluidised granular mass. It has also been shown that in many cases heat exchangers with fludised particles in the tubes can still be used in situations where conventional heat exchangers can no longer generally be used. For example, unless a heat exchanger can be used, a process liquid can only be heated by direct steam injection, with all the unfavourable consequences of this, such as loss of condensate and dilution of any process flow.

Thus, it may be stated that a heat exchanger with a fluidised granular mass in the tubes performs superior heat transfer, even at low or very low speeds of the first heat exchanging medium, and that serious contamination of tube walls can be overcome very effectively with it.

The extremely good heat transfer at low speeds (flow rates) of the first heat exchanging liquid may lead a designer to use a short length for the tubes and to use a large number of parallel tubes. In a number of cases this may be favourable, but sometimes this low flow rate can be unfavourable because of the large numbers of tubes involves large tube plate diameters and a great amount of drilling work. The low flow rate frequently also means that a large cross-section of flow is provided for the second heat exchanging liquid on the outside of the tubes. This means that the second heat exchanging liquid can only flow at a slow rate along the outside of the tubes, as a result of which the heat transfer to this outer side of the tubes is reduced, with unfavourable effects on the heat transmission coefficient of the heat exchanger.

The flow rate of the second heat exchanging medium may be increased, for example, by using a large number of baffles outside the tubes, but this in turn again increases the cost price of the heat exchanger considerably, and is therefore undesirable.

A heat exchanger with a fluidised granular mass in the tubes, is also described in Dutch patent application No. 8102024 (EP No. 822004370), both published after the priority date here claimed. In this case, however, the above-mentioned disadvantage of low flow rate of the second medium is avoided by using a falling liquid film of the second medium on the outside of the tubes. This results in very good heat transfer, despite a low total mass flow of the second medium. However, one disadvantage of this is that in many cases a separate pump is required to discharge the second medium. There is also the risk that gases may dissolve from the volume outside the tubes into the second medium as it flows along the tubes in the form of a film. Such dissolved gases are often undesirable if the second medium has to be re-used in a particular process, for example, if boiler feedwater is the second medium.

SUMMARY OF THE INVENTION

The object of this invention is to provide a method of operating a liquid-liquid heat exchanger which has a granular mass fluidized in the tubes by the first medium whilst reducing or avoiding the disadvantages arising from a low flow rate of the second medium. In particular, it is sought to achieve good heat transfer on the outside of the tubes, even at low flow rates of the second medium.

The present invention consists in that the chamber for the second medium contains, around and between the tubes, a loosely packed solid particulate filling material, and in that the longitudinal superficial velocity of the second medium between the pipes $U_{l,s}$ satisfies the condition $0.05 < U_{l,s} < 0.25$ m/sec.

The longitudinal superficial velocity $U_{l,s}$ is hereby defined as the average velocity of the liquid in the direction of the tubes over the cross-sectional area of the chamber between and around the tubes, ignoring the reduction in that area caused by the filling material.

Surprisingly, it has been shown that these measures improve the heat transfer to the outside of the tubes considerably. It is thought that this is partly due to the greatly reduced clearance between the tubes, causing a higher proportion of the liquid flowing between the tubes to come into contact with the tube walls. Moreover, a low overall flow rate of the second medium can be retained, although flow speed of this medium is locally considerably increased by the presence of the filling material and is also locally highly variable in size and direction. This results in a high degree of turbulence and intensive transfer of heat from the tube walls, which are all reasons for the greatly improved heat transfer.

With the method of the invention, the second medium may be retained on the outside of the tubes under any pressure required, and the space in the chamber around the tubes can be kept completely filled with this second medium. This means that a pump need not be required to discharge the second medium from the heat exchanger. Furthermore, solution of gases in this heat exchanging medium can be avoided.

If the dimensions of the particles of the filling material are too small, the resistance to liquid flow of this filling material will increase considerably, leading to a need for pumping of the second medium or increasing the pumping effort needed. On the other hand, if the dimensions of the particles are too large, there is the risk of highly irregular filling of the clearance between the tubes, with the result that the desired effect will only be partially achieved. Good results are obtained if the dimensions of the particles of the filling material are substantially between 10% and 90% of the shortest distance between the tubes in the chamber. These dimensions should preferably be chosen between 25% and 75% of the said shortest distance between the tubes. For the heat transfer rate, this particle size is not particularly important if a uniform mass flow of liquid is maintained.

It is desirable that the filling material as a whole has only a small area of contact with the tubes, since the possibilities of heat transfer from the tubes to the liquid would be limited by this contact area. Preference is therefore given to filling material in the form of one or more of balls, rings or cylinders.

Good results have generally been obtained with filling material consisting of a ceramic material. For example, support elements for catalyst material may be suitably used for this purpose.

It is important to prevent the filling material from being entrained by the second heat exchanging medium through a discharge outlet of the chamber. This can be achieved by providing a strainer plate, for example, for this outlet. In a preferred embodiment, however, a perforated support plate for the filling material is arranged above the outlet.

BRIEF INTRODUCTION OF THE DRAWINGS

A preferred method of operating a heat exchanger according to the invention will now be described by way of non-limitative example with reference to the accompanying drawing in which the single FIGURE is a diagrammatic vertical sectional view of a liquid-liquid heat exchanger suitable for carrying out the method.

DESCRIPTION OF THE PREFERRED EMBODIMENT

Figure 1:
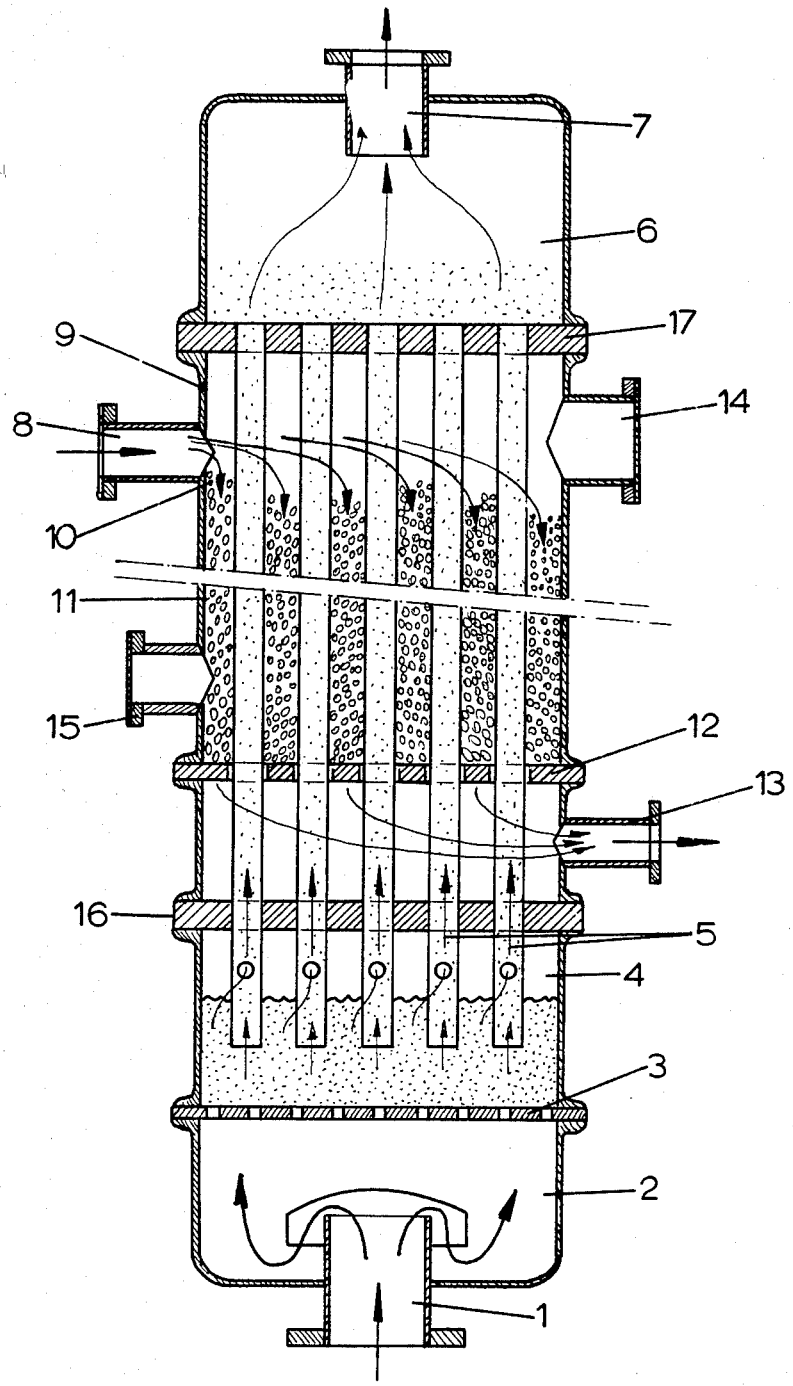

The heat exchanger shown in the FIGURE has an inlet 1 for a first liquid heat exchanging medium, which opens into an inlet chamber 2. From this, the liquid flows via a distribution plate 3 into a lower chamber 4, which is partially filled with granular material. A plurality of tubes 5 opens into the lower chamber 4. At their upper ends these tubes 5 open into an upper chamber 6, from which an outlet 7 is provided. During operation the granular mass in the lower chamber 4 is entrained by the first heat exchanging medium and retained in a fluidised condition inside the tubes 5 and to some extent inside the upper chamber 6.

Near their lower ends and at their upper ends the tubes are secured in tube plates 16 and 17. The space around the tubes 5 is bounded above and below by the tube plates 16 and 17, and also by a chamber wall 9 to form a chamber for downward flow of the second heat exchangin medium, through which the tubes 5 extend spaced apart and parallel to one another. An inlet 8 is arranged at the top and an outlet 13 at the bottom of the chamber 9 for the second medium. This second medium therefore flows through the heat exchanger in counterflow with the first heat exchanging medium.

The open space 10 between and around the tubes in the chamber is mostly filled with a solid particulate filling mass 11, which is supported by a support plate 12 closely above the outlet 13. In the case illustrated the shortest distance between adjacent tubes is approximately 18 mm, and the filling material consists of ceramic spheres or balls with a diameter of approximately 8 mm. The balls are loosely packed.

It is pointed out that apart from the support plate 12 and the filling mass in the chamber 9, the apparatus described corresponds essentially to the heat exchanger of Dutch patent application No. 7903939 mentioned above.

A separate filling opening 14 is provided for filling the chamber with the filling mass, whilst this filling mass can be removed through an opening 15. Both the opening 14 and the opening 15 are sealed with blind flanges during operation of the heat exchanger.

The filling mass is very simple to employ, and only involves little extra cost. Given a suitable choice of shape and dimensions of the particles of the filling mass, no appreciable additional resistance to liquid flow is introduced. Moreover, the distribution of the liquid between the pipes can be substantially improved.

In experiments with water as the first and second heat exchanging media it has been found that with suitable choice of dimensions and filling material, heat transmisson coefficients of 3000 $W/m^2{}^\circ K$. and more can be achieved.

Only a single chamber, whith its inlet 8 and outlet 13 is shown in the FIGURE. However, the heat exchanger may have several separate such chambers placed one above the other along the tubes, so that if necessary different liquids can be heated. Instead of such a transverse division, it is also possible to divide the vessel in the longitudinal direction so that a number of tubes are used for heating a liquid other than that for which the rest of the tubes are used. All these variations and others embodying the principle of the invention, fall within the protection sought for the invention.

In an apparatus as shown in the drawings, with 17 tubes 5 made of stainless steel and having 48 mm internal diameter and 51 mm external diameter and the chamber 9 filled with 8 mm spheres as mentioned above, water at 20° C. was passed up the tubes 5 at a flow rate (in total) of 11 l/sec. and water at 100° C. was passed downwardly through the chamber 9. The fluidised particulate material in the tubes 5 consisted of glass balls with a diameter of 2 mm. The flow rate in the chamber 9 corresponded to a longitudinal superficial velocity $U_{l,s}$ as defined herein of 0.08 m/sec. A heat transmission coefficient of 2100 $W/m^2 K$. was achieved.

What is claimed is:

1. Method for improving the speed of passage of a second heat-exchanging medium in operating a liquid-liquid heat exchanger comprising the steps of passing a first heat exchanging medium upwardly through a plurality of upwardly directed tubes while a granular mass is kept fluidized in said tubes by the flow of the first medium and passing a second heat-exchanging medium downwardly through a chamber through which said tubes extend spaced apart whereby heat-exchange takes place in the chamber through the tube walls, said chamber containing around and betwwen the tubes a loosely packed solid particulate ceramic filling material through which the second medium flows, and the longitudinal superficial velocity of the second medium between the tubes ($U_{l,s}$) satisfying the relation $0.05 < U_{l,s} < 0.25$ m/sec.

2. Method according to claim 1 wherein the dimensions of the particles of the filling material are substantially between 10% and 90% of the shortest spacing between the tubes in the chamber.

3. Method according to claim 2, wherein the dimensions of the particles are between 25% and 75% of the said shortest distance between the tubes.

4. Method according to claim 1 wherein the filling material is in the form of one of balls, rings or cylinders.

5. Method according to any one of claims 1,2 and 4 wherein a perforated support plate for the filling material is arranged in the chamber above the discharge outlet of the chamber for the second medium.

* * * * *